US011853012B2

(12) United States Patent
Helfer et al.

(10) Patent No.: US 11,853,012 B2
(45) Date of Patent: Dec. 26, 2023

(54) MACHINE FOR WINDING A WATCH AND/OR HOROLOGICAL MOVEMENT

(71) Applicant: ETA SA Manufacture Horlogere Suisse, Grenchen (CH)

(72) Inventors: Jean-Luc Helfer, Le Landeron (CH); Cédric Decosterd, Bienne (CH); Nicolas Loetscher, Nidau (CH); Philipp Schneider, Bern (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 411 days.

(21) Appl. No.: 17/259,716

(22) PCT Filed: Feb. 6, 2020

(86) PCT No.: PCT/EP2020/053033
§ 371 (c)(1),
(2) Date: Jan. 12, 2021

(87) PCT Pub. No.: WO2020/182381
PCT Pub. Date: Sep. 17, 2020

(65) Prior Publication Data

US 2021/0232097 A1 Jul. 29, 2021

(30) Foreign Application Priority Data

Mar. 8, 2019 (EP) ..... 19161582

(51) Int. Cl.
*G04C 1/06* (2006.01)
*G04D 7/00* (2006.01)

(52) U.S. Cl.
CPC ..... *G04C 1/065* (2013.01); *G04D 7/009* (2013.01)

(58) Field of Classification Search
CPC ..... G04C 1/065; G04D 7/009
See application file for complete search history.

(56) References Cited

U.S. PATENT DOCUMENTS 2,863,345 A * 12/1958 Fiechter ..... G04D 7/009 968/40
3,310,292 A * 3/1967 Moore ..... G01N 33/48 366/198

(Continued)

FOREIGN PATENT DOCUMENTS

CN 105051624 A 11/2015
CN 106681121 A 5/2017

(Continued)

OTHER PUBLICATIONS

Machine translation for WO 2014146924 (Year: 2023).*

(Continued)

*Primary Examiner* — Edwin A. Leon
*Assistant Examiner* — Sean R Brannon
(74) *Attorney, Agent, or Firm* — Oblon, McClelland, Maier & Neustadt, L.L.P.

(57) ABSTRACT

A winding machine includes motorization means arranged to move a support, carrying at least one watch or one horological movement, along a path in a plane. The motorization means are arranged to move each support parallel to a starting position corresponding to the loading or unloading of a watch or of a movement on the support, the axes of a three-dimensional frame of reference specific to the support always remaining parallel to the oriented directions that the axes occupy in the starting position.

20 Claims, 6 Drawing Sheets

(56) References Cited

U.S. PATENT DOCUMENTS

| | | | | | |
|---|---|---|---|---|---|
| 5,060,151 | A * | 10/1991 | Mikyska | B01F 35/212 318/260 |
| 5,608,693 | A * | 3/1997 | Richards | B01F 31/26 368/10 |
| 2007/0159032 | A1* | 7/2007 | Louie | G04D 7/009 312/221 |
| 2009/0225632 | A1 | 9/2009 | Agnoff | |
| 2015/0098300 | A1* | 4/2015 | Annau | B01F 35/323 366/208 |

FOREIGN PATENT DOCUMENTS

| | | | | |
|---|---|---|---|---|
| DE | 195 35 229 | A1 | 4/1997 | |
| DE | 19535229 | A1 * | 4/1997 | G04B 5/02 |
| JP | 49-106857 | A | 10/1974 | |
| WO | WO-2006050743 | A1 * | 5/2006 | G04B 3/006 |
| WO | WO 2014/146924 | A1 | 9/2014 | |
| WO | WO-2014146924 | A1 * | 9/2014 | G04D 7/009 |

OTHER PUBLICATIONS

Machine translation for DE 19535229 (Year: 2023).*
Machine translation for WO 2006050743 (Year: 2023).*
Combined Chinese Office Action and Search Report dated Dec. 7, 2021 in corresponding Chinese Patent Application No. 202080019739.0 (with English Translation of Category of Cited Documents) 9 pages.
International Search Report dated Apr. 15, 2020 in PCT/EP2020/053033 filed on Feb. 6, 2020, 2 pages.

* cited by examiner

MACHINE FOR WINDING A WATCH AND/OR HOROLOGICAL MOVEMENT

FIELD OF THE INVENTION

The invention relates to a machine for winding a watch and/or horological movement, including at least one support arranged to carry at least one object consisting of a watch or a horological movement, and including motorisation means arranged to move each said support.

BACKGROUND OF THE INVENTION

The winding of horological movements, or watches, in particular for testing purposes, is often carried out with devices imparting a rotational movement to the movements, for example with a device of the "Cyclotest" type, and optionally with different combined rotations.

A device of the "Chapuis" type imparts to the movements a rotation along a horizontal axis, alternately in two directions, for example with two revolutions in one direction, then two revolutions in the other direction.

Other mechanisms impart to the movements a rotation in one single direction at constant speed, with a variant where all the movements are aligned on the same axis of rotation.

Another variant of a "Chapuis" type device includes a strongly inclined plate, for example at 60°.

Existing apparatuses have similar flaws. The loading time is long, due to often tedious handling, and the operating time is substantial: it often takes more than thirty minutes to wind an automatic calibre twenty-four hours. If the speed of rotation is increased in order to wind more quickly, then the movements furthest from the axis of rotation may no longer carry out the winding correctly because of the centrifugal acceleration.

Document U.S. Pat. No. 2,863,345A in the name of FIECHTER describes one machine for winding comprising a rotary support, drive means for rotating this support continuously in a single direction about its axis, rotating mobiles carrying articles to be wound rotatably mounted on said support on secondary axes parallel to the axis of the support and radially spaced therefrom, and disengageable means for driving by friction each of the rotary mobiles.

Document DE19535229A1 in the name of DOETSCH describes a winder for automatic clocks and watches to ensure that they are kept in service. A casing base supports an electric motor, connected to the mains and to a transformer, and a rotating wheel is carried on the edge by two rollers, one of which acts as a friction drive. This one is actuated by a worm of the motor. Foam pads are mounted in holes cut in the rotating wheel to receive watches. The vertical rotation of the wheel thus rotates the watches on a plane, activating the eccentrics which wind them. The watches are easily interchangeable. The system also maintains other temporal mechanisms, such as the days of the week, the phases of the moon.

Document WO2014/146924A1 in the name of M & E UHRENBEWEGER MANUFAKTUR describes a watch winder having a certain number of receiving cylinders for receiving watches and allowing a very uniform movement of the watches to wind the mechanical movement, by peripheral cylindrical drive.

SUMMARY OF THE INVENTION

The invention proposes to introduce the standardisation of the winding of movements of the same production batch, for the purposes of establishing fixed parameters for their control and qualification.

To this end, the invention relates to a machine for winding a watch and/or horological movement, according to claim 1.

BRIEF DESCRIPTION OF THE DRAWINGS

Other features and advantages of the invention will become apparent upon reading the detailed description which follows, with reference to the appended drawings, where.

DETAILED DESCRIPTION OF THE PREFERRED EMBODIMENTS

Figure 1:
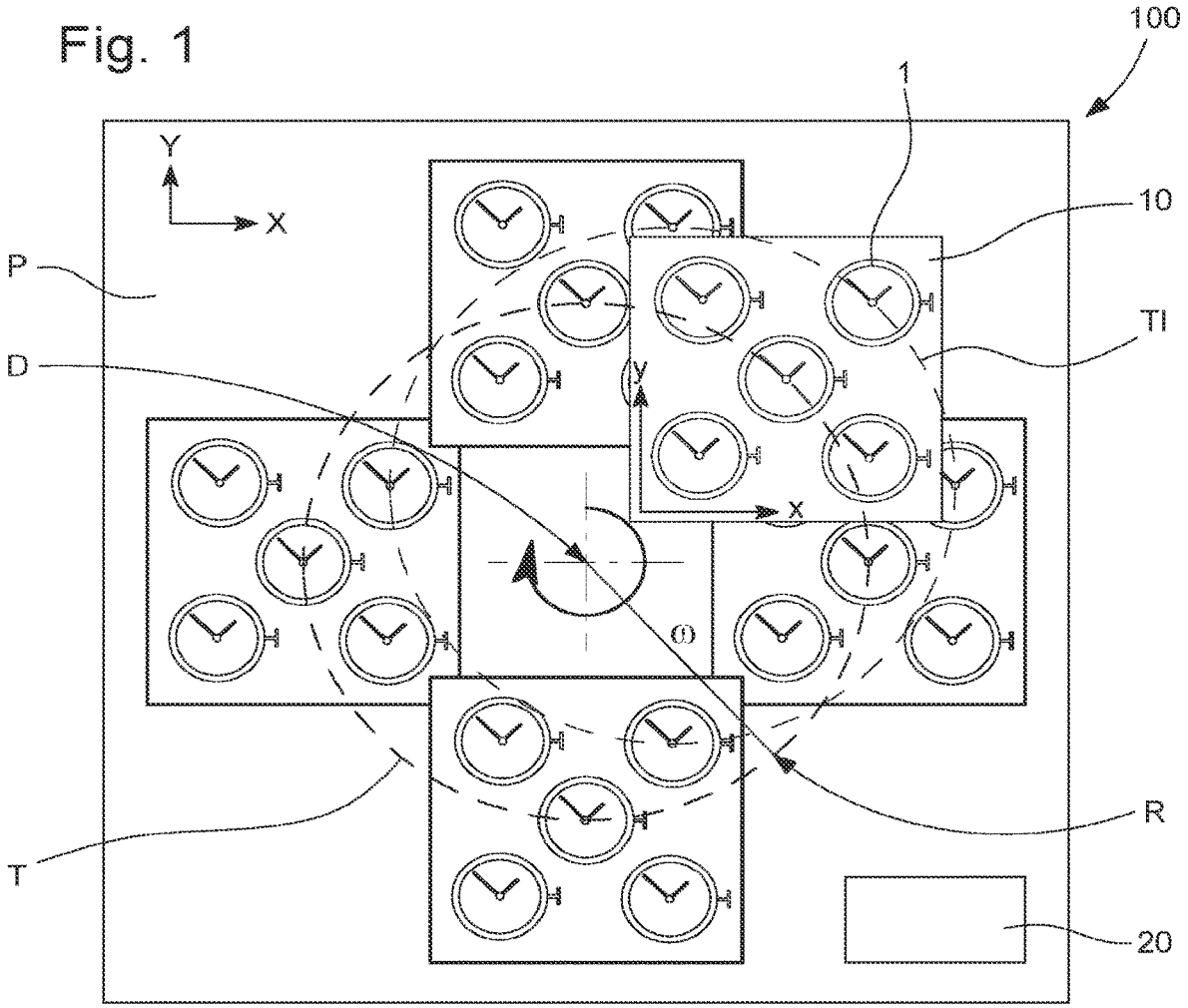
FIG. 1 shows, schematically and in plan view, a winding machine according to the invention, including motorisation means for paraxially moving a plate, this plate being shown carrying five watches, and in different positions in space.
Figure 2:
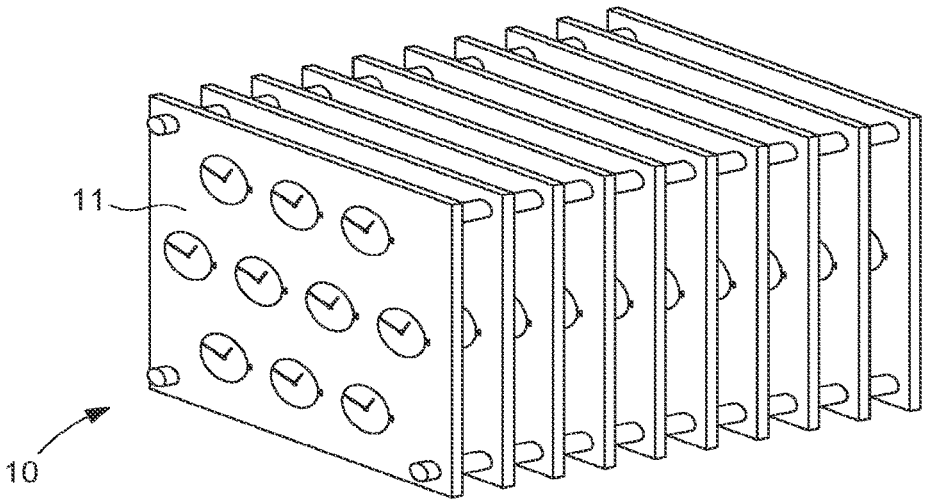
FIG. 2 shows, schematically, and in perspective, a support including several levels for receiving movements or watches, these levels being in this particular case levels parallel to each other.
Figure 3:
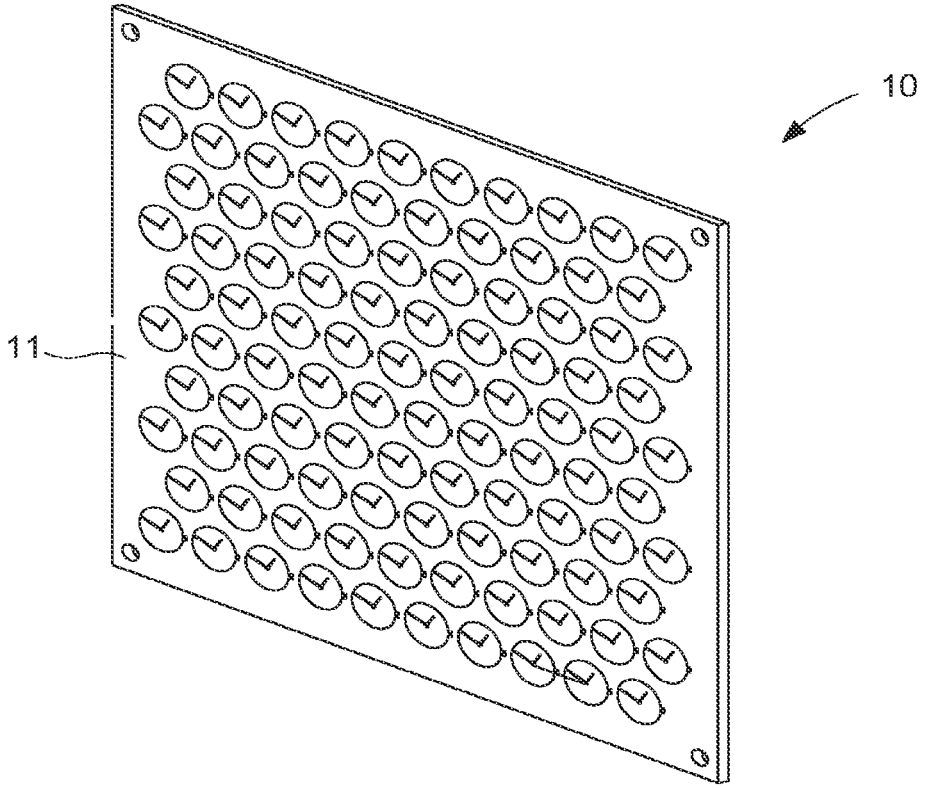
FIG. 3 shows, schematically, and in perspective, a support consisting of a large plate, able to house several tens of movements.

The invention relates to a winding machine 100 for a watch and/or a horological movement, including at least one support 10 arranged to carry at least one object 1 consisting of a watch or a horological movement, and including motorisation means 20 arranged to move each support 10.

According to the invention, these motorisation means 20 are arranged to move each support 10 parallel to a starting position corresponding to the loading or unloading of this at least one object 1 on this at least one support 10, the axes of a three-dimensional frame of reference specific to this support 10 always remaining parallel to the oriented directions that they occupy in this starting position.

In particular, the motorisation means 20 are arranged to move each support 10 along a path T, in a plane P, and in particular but in a non-limiting manner about a median axis D, keeping the orientation of the support fixed relative to a fixed frame of reference, so that each point of the support follows the same path, except for a translation of the path in its entirety.

More particularly, the movement of each support takes place paraxially relative to a main frame of reference of the plane P made up of two main orthogonal directions X and Y of the plane P. A secondary frame of reference of two secondary orthogonal directions x and y of each support 10 remains parallel to the main frame of reference, so that each object 1 carried by a support 10 follows an individual path TI, which is parallel or coincides with the path T of the support 10 which carries it.

More particularly, the path T is a closed path. In a particular variant, the support 10 can travel this closed path in a single direction.

And the motorisation means 20 are arranged to impart to each support 10 a movement such that the value of the acceleration imparted to the support 10 during its evolution along its path T is at any point greater than the value of the acceleration of gravity.

More particularly, this movement is imparted with an angular speed w relative to a median axis D, the instantaneous position of the support of which is spaced by a radial value R, with a central acceleration, such that the value of the acceleration imparted to the support 10 during its evolution along its path T is at any point greater than the value of the acceleration of gravity. More particularly, the motorisation means 20 are arranged to impart to each support 10 an angular speed w relative to the median axis D, the instantaneous position of the support of which is spaced by a radial value R, with a central acceleration, such that the value of the radial acceleration imparted to the support 10 during its evolution along its path T is at any point greater than the value of the acceleration of gravity. More particularly, the movement of each support 10 is a uniform circular movement, along the path T which is circular, and the radial acceleration, equal to $\omega^2 R$, is greater than the value of the acceleration of gravity.

More particularly, the movement of a point of the support is in a plane P.

More particularly, the movement of each point of each support 10 is a circular movement in a plane PI, of radius R and travelled at a frequency N, and the radial acceleration, equal to $(2\pi N)^2 R$, is greater than the value of the acceleration of gravity.

More particularly the plane PI of each point of each support 10 is a horizontal plane, perpendicular to the direction of the gravity field.

More particularly, the frequency N is greater than or equal to 100 revolutions per minute, and the minimum radial value R of the path T relative to the median axis D is greater than or equal to 5 millimetres. More particularly still, the frequency N is greater than or equal to 300 revolutions per minute, and the minimum radial value R of the path T relative to the median axis D is greater than or equal to 10 millimetres.

More particularly, at least one support 10 includes several levels for receiving such objects 1. More particularly, at least one support 10 is a prism including at least ten parallel levels, each level being arranged to carry at least ten rows of at least ten objects 1.

More particularly all the supports 10, that the winding machine 100 includes, are driven by the same kinematics, so as to impart the same movements to all the objects 1 carried by the supports 10 at any time.

More particularly, the winding machine 100 includes piloting means 200, which are arranged to pilot the motorisation means 20 to ensure automatic winding of each object 1 carried by the winding machine 100, and to manage the duration of the automatic winding.

More particularly, the winding machine 100 includes running control means 30, for controlling the running of each object 1 carried by the winding machine 100, piloted by the piloting means 200.

More particularly, the winding machine 100 includes state control means 40, for controlling the state of each object 1 carried by the winding machine 100, these state control means 40 are piloted by the piloting means 200. These state control means can in particular include at least a photographic apparatus, or a camera, or else a mobile telephone, or "Smartphone®" or "iphone®" or the like, and image processing means for interpreting the position of a display such as a hand, disc, or the like, relative to a graduated scale, dial, or the like. The optical state controls of watches or horological movements are used during chronometric precision controls, as in patent EP2458458B1 in the name of THE SWATCH GROUP RESEARCH & DEVELOPMENT Ltd.

More particularly, the piloting means 200 are arranged to measure the compliance of running or/and state of each object 1 carried by the winding machine 100 relative to a frame of reference, and to send the results thereof to a production management system that the winding machine includes, or into which it is integrated. In a variant, the piloting means 200 edit or store a certificate of compliance with a frame of reference, or are arranged to designate any object 1 that does not comply with the frame of reference, for return to a retouching circuit.

More particularly, the winding machine 100 includes automated handling means 50 which are arranged for loading and/or unloading such objects 1 on or off supports 10. More particularly still, these automated handling means 50 are able to take an object 1 considered non-compliant with a reference system, to orient it in a retouching circuit.

More particularly, the winding machine 100 includes at least one pallet 60, which is arranged to carry a plurality of objects 1 loaded on the winding machine 100 and/or unloaded from the winding machine 100, and the automated handling means 50 are arranged for loading and/or unloading pallets 60 relative to the supports 10.

More particularly, the winding machine 100 includes an orbital winding mechanism, of differential type, including a fixed wheel 12 centred on the median axis D, and a planet carrier 11, which is rotated by the motorisation means 20 about the median axis D, and which carries a geartrain 14 including a planetary wheel 15. This planetary wheel 15 carries at least one support 10, and is driven by at least one intermediate wheel 13 meshing with the fixed wheel 12.

More particularly, the radius of the planetary wheel 15 is equal to that of the fixed wheel 12.

More particularly, the geartrain 14 includes a single intermediate wheel 13, the radius of which is equal to that of the planetary wheel 15.

More particularly, the motorisation means 20 are arranged to move each support 10 parallel to a starting position corresponding to the loading or unloading of said at least one object 1 on said at least one support 10, in the plane P, each support 10 moving in said plane P with a planetary movement along a closed curvilinear path T, surrounding a median axis D, and wherein the axes of a three-dimensional frame of reference specific to the support 10 always remain parallel to the oriented directions that they occupy in said starting position. And the motorisation means 20 are arranged to impart to each support 10 a movement such that the value of the acceleration imparted to the support 10 during its evolution along its path T is at any point greater than the value of the gravity acceleration.

More particularly, the orientation of the plane P is maintained constant relative to a frame of reference in the space constituted by the vertical, the meridian and the parallel of the place.

In a particular embodiment, the invention uses an XY table, that is to say a motorised, horizontal plate, with a programmable translational displacement along X and Y, the plate always remaining parallel to its initial position, therefore without rotation. The invention consists in programming a circular movement, of constant radius R and of constant angular speed ω. An automatic winding mechanical watch movement, placed on such a plate, then feels a centrifugal acceleration $\omega^2R$ which rotates at speed ω. By choosing ω and R so that the acceleration is equal to or greater than 1 g (9.81 $m/s^2$), this acceleration will cause the oscillating mass of the movement to rotate at speed ω, which will allow the movement to be wound.

Figure 4:
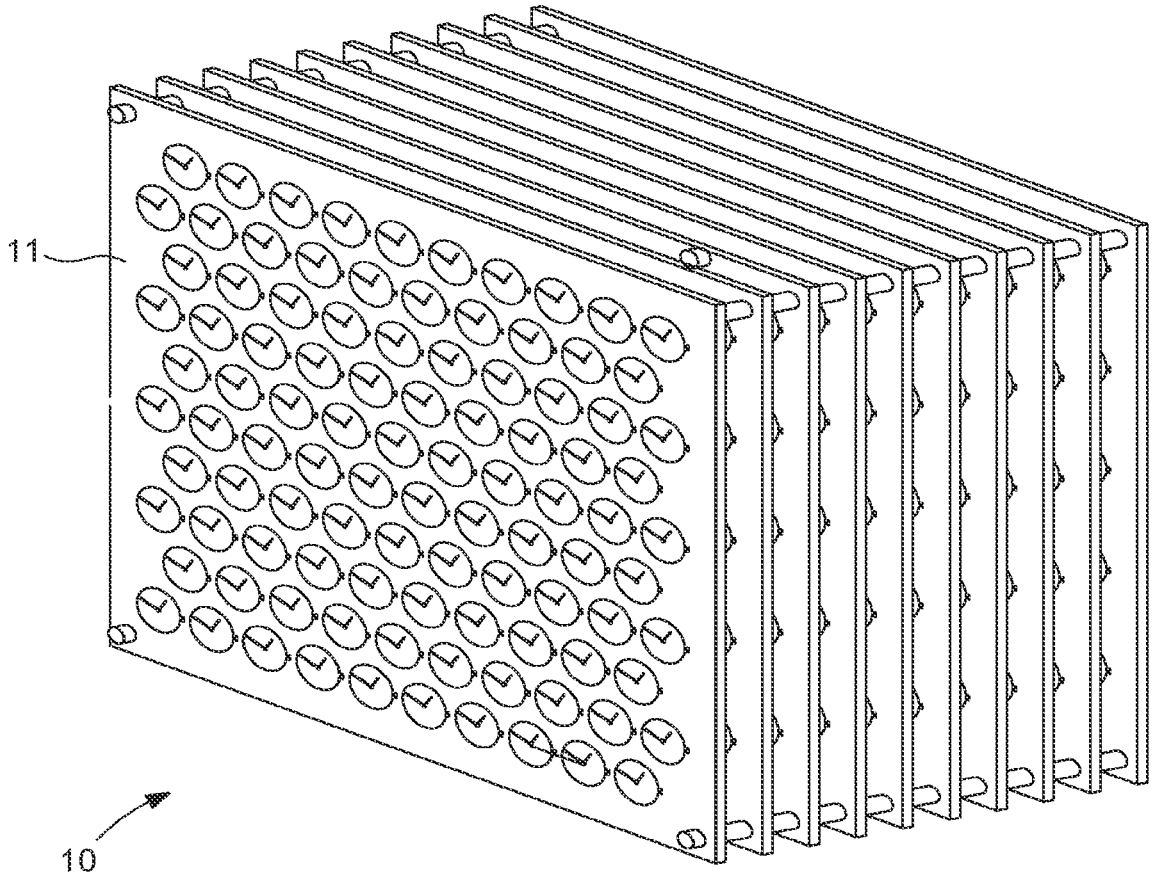
FIG. 4 shows, schematically, and in perspective, the combination of the variants of FIGS. 2 and 3, with a support including several levels for receiving movements each including a large plate, the support thus being able to carry several hundreds of movements.
Figure 5:
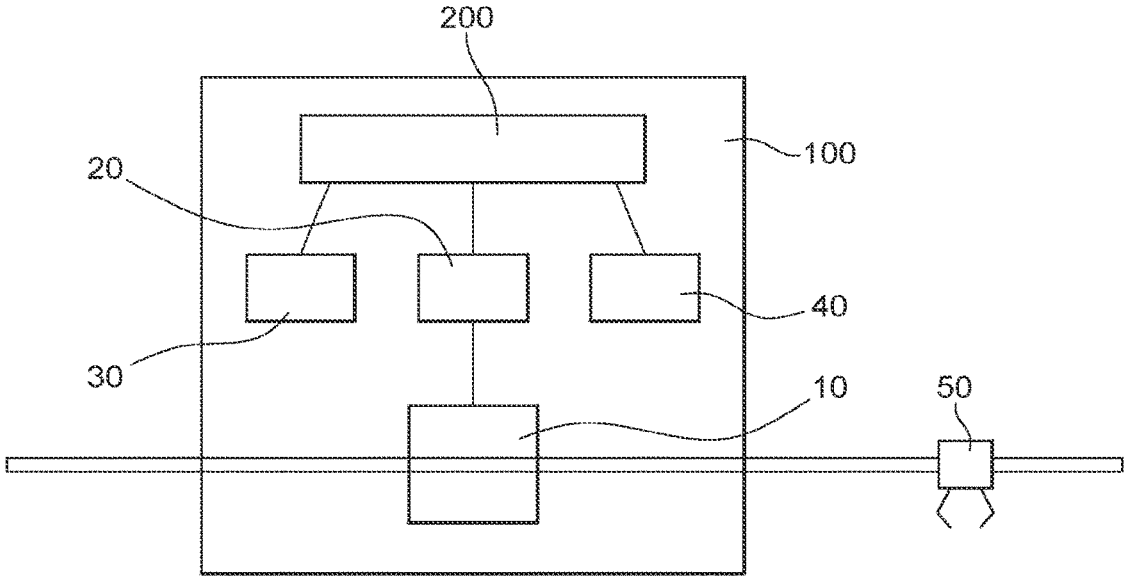
FIG. 5 shows, schematically and in plan, a machine according to the invention including motorisation means, running control means, state control means, and automated handling means.
Figure 6:
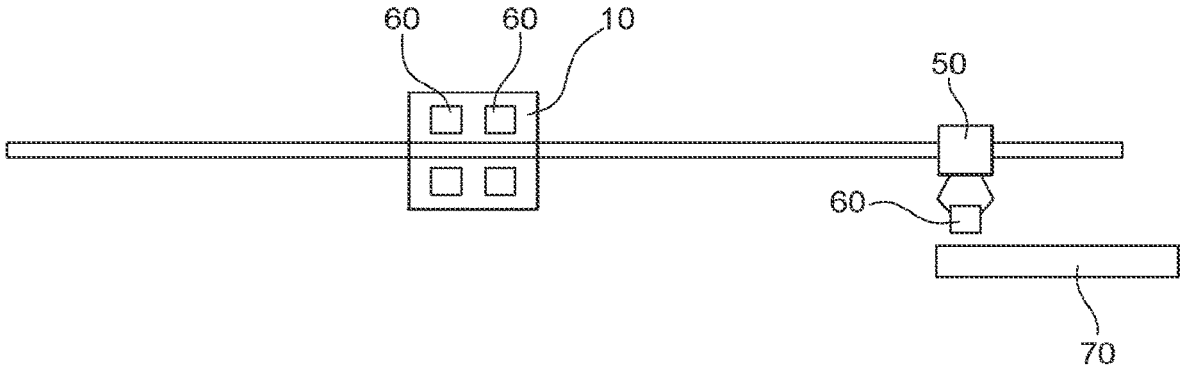
FIG. 6 shows, similarly to FIG. 5, automated handling means arranged to serve supports by feeding or removing pallets carrying movements.
Figure 7:
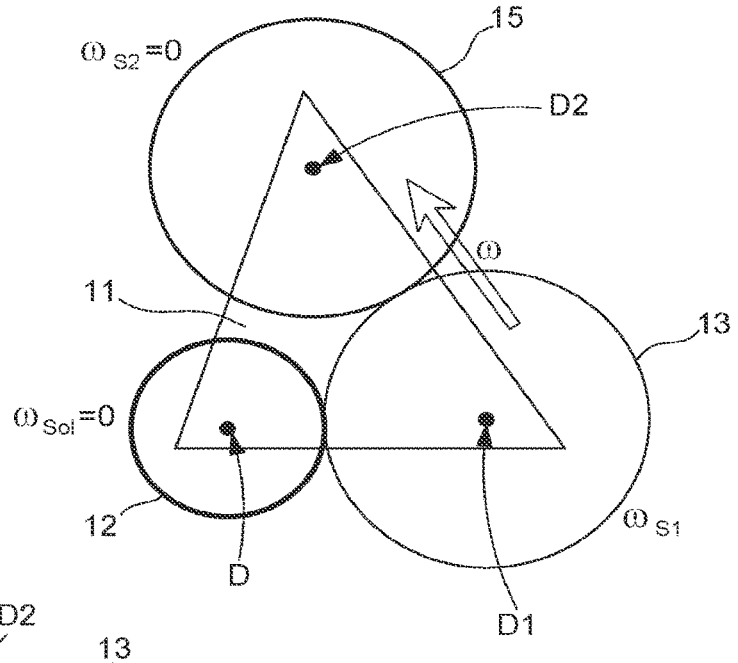
FIG. 7 shows, schematically and in plan, an orbital winding mechanism, for the operation of the handling support, including a fixed wheel, and a planet carrier, which is rotated by the motorisation means, and which carries a geartrain including a planetary wheel carrying a support and which is driven by an intermediate wheel meshing with the fixed wheel and whose radius is equal to that of the planetary wheel.
Figure 8:
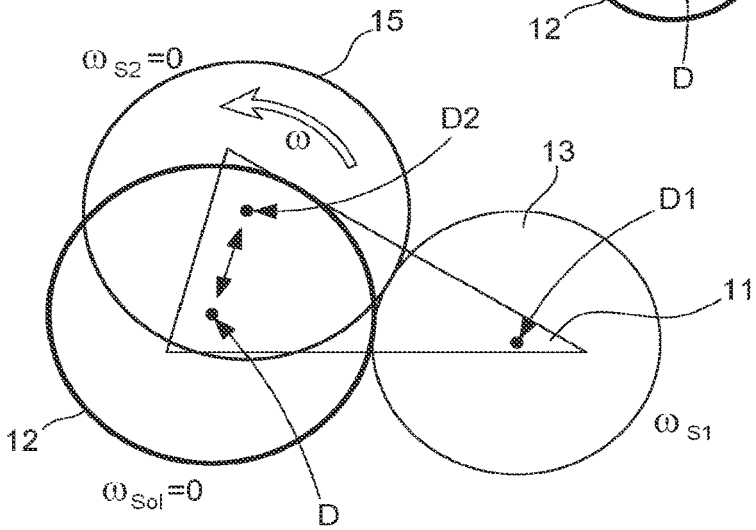
FIG. 8 shows, similarly to FIG. 7, an orbital winding mechanism where the radius of the planetary wheel is equal to that of the fixed wheel.
Figure 9:
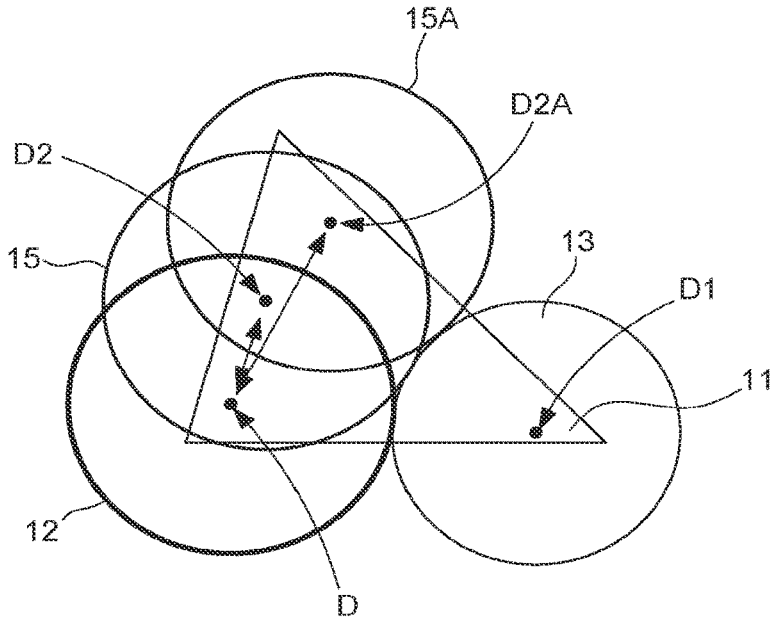
FIG. 9 shows, similarly to FIG. 7, an orbital winding mechanism whose centre distance between the planetary wheel and the fixed wheel is adjustable.
Figure 10:
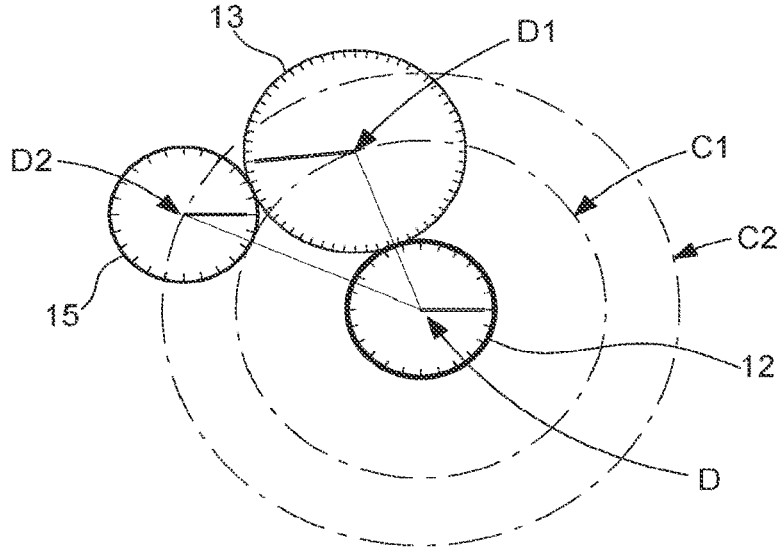
FIGS. 10 to 12 show, similarly to FIG. 7, an orbital winding mechanism in different positions.
Figure 11:
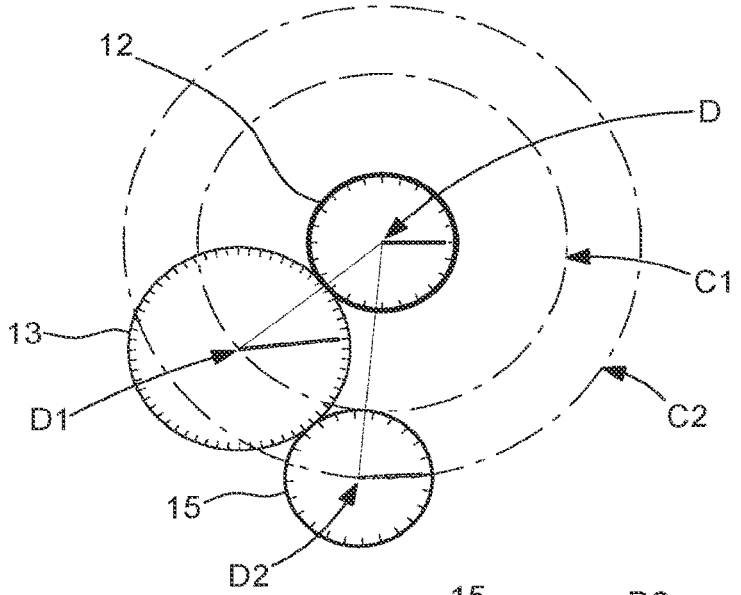
Figure 12:
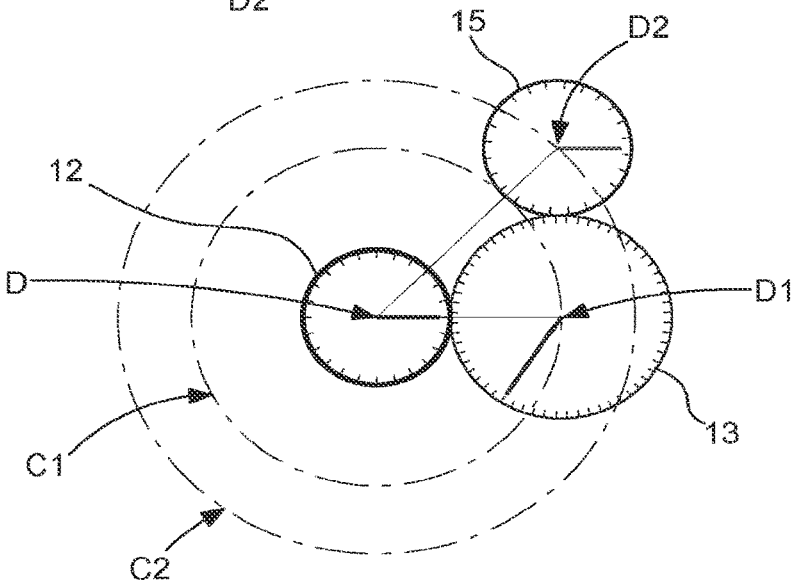
Figure 13:
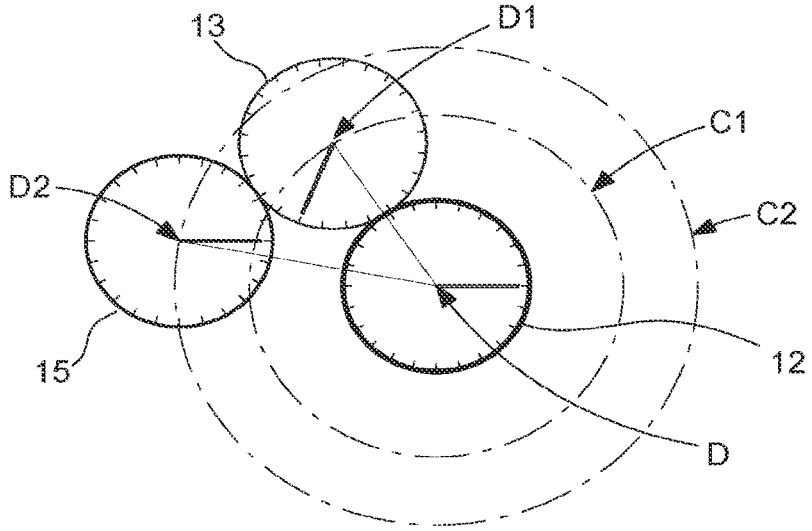
FIGS. 13 to 15 show, similarly to FIG. 7, another orbital winding mechanism in different positions.
Figure 14:
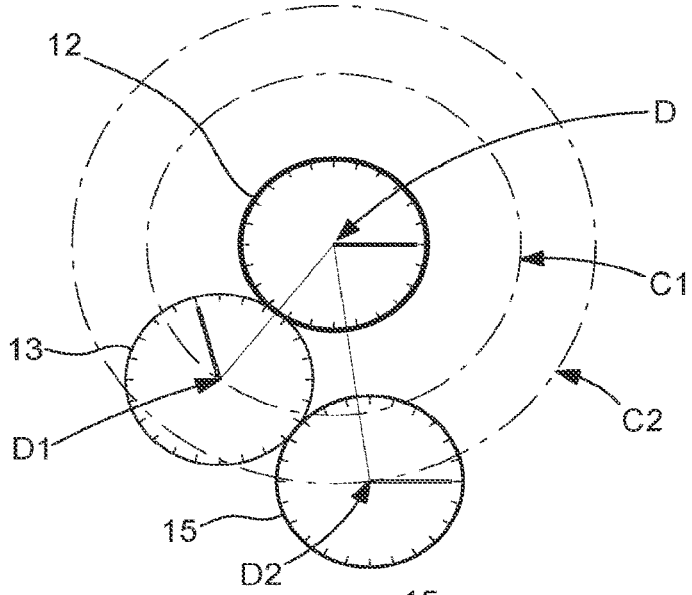
Figure 15:
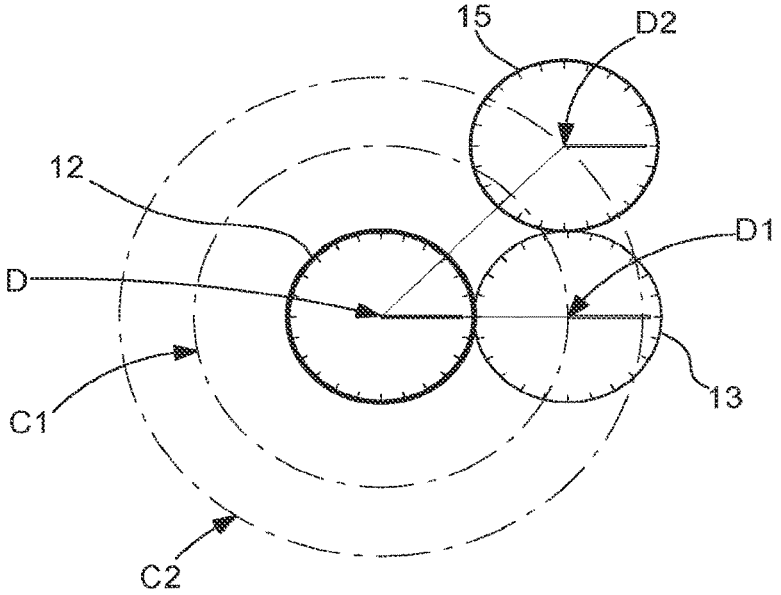

The invention provides notable advantages:

possible to wind at high speed: of the order of three minutes to wind an automatic calibre twenty-four hours, for example with ω=300 revolutions/minute, R=12 mm, to have a centrifugal acceleration of about 1.2 g;

all the movements of the plate follow exactly the same circular path, therefore undergo the same acceleration, the movements are wound identically, and their qualification is therefore done under exactly the same winding conditions; this makes the certification of movements fairer, at the manufacturer as well as in a certifying body;

the invention therefore allows large batches of movements to be wound in parallel, for example a cube of 10×10×10 movements as in FIG. 4.

The invention claimed is:

1. A machine for winding at least one of a watch and a horological movement, comprising:

at least one support configured to carry at least one object consisting of a watch or an automatic winding horological movement including at least one oscillating mass, wherein the machine is configured to move each support parallel to a surface with a starting position corresponding to one of a loading and an unloading of the at least one object on the at least one support, and axes of a three-dimensional frame of reference specific to each support always remain parallel to oriented directions that the axes occupy in the starting position.

2. The winding machine according to claim 1, wherein the machine is configured to impart to each support a movement such that a value of an acceleration imparted to the support is at any time greater than a value of an acceleration of gravity.

3. The winding machine according to claim 1, wherein a movement of a point of the support is in a plane, and the machine is configured to move each support along a path in the plane about a median axis.

4. The winding machine according to claim 1, wherein a movement of each point of each support is a circular movement in a plane of a radius and travelled at a frequency, and a radial acceleration is greater than a value of an acceleration of gravity.

5. The winding machine according to claim 4, wherein the plane of each point of each support is a horizontal plane, perpendicular to a direction of a gravity field.

6. The winding machine according to claim 1, wherein a frequency of movement of each point is greater than or equal to 100 revolutions per minute, and a minimum radial value of a path relative to a median axis is greater than or equal to 5 millimeters.

7. The winding machine according to claim 1, wherein the at least one support includes several parallel levels for receiving the at least one object.

8. The winding machine according to claim 1, wherein the at least one support is a prism including at least ten parallel levels, each level being configured to carry at least ten rows of at least ten of the objects.

9. The winding machine according to claim 1, wherein each support that the machine includes is driven by the same kinematics, so as to impart the same movements to all the objects carried by each support at any time.

10. The winding machine according to claim 1, wherein the machine is configured to pilot and ensure automatic winding of each object carried by the winding machine, and to manage a duration of the automatic winding.

11. The winding machine according to claim 10, wherein the machine is configured to control running of each object carried and piloted by the winding machine.

12. The winding machine according to claim 10, wherein the machine includes optical state control means for controlling a state of each object carried and piloted by the winding machine.

13. The winding machine according to claim 10, wherein the machine is configured to measure at least one of compliance of running or a state of each object carried by the winding machine relative to a frame of reference, and to send results thereof to a production management system that is one of included in and integrated into the winding machine.

14. The winding machine according to claim 1, wherein the machine is configured to at least one of load or unload the objects one of on or off the supports.

15. The winding machine according to claim 14, wherein the machine includes at least one pallet configured to carry a plurality of the objects at least one of loaded on or unloaded from the winding machine, and the machine is configured for at least one of loading or unloading the pallets one of on and off the supports at least at the starting position.

16. The winding machine according to claim 1, wherein the machine includes an orbital winding mechanism, including a fixed wheel centered on a median axis, and a planet carrier which is rotated by the machine about the median axis and which carries a geartrain including a planetary wheel carrying the support and driven by at least one intermediate wheel meshing with the fixed wheel.

17. The winding machine according to claim 16, wherein a radius of the planetary wheel is equal to a radius of the fixed wheel.

18. The winding machine according to claim 16, wherein the geartrain includes a single intermediate wheel a radius of which is equal to a radius of the planetary wheel.

19. The winding machine according to claim 1, wherein the machine is configured to move each support parallel to the surface with the starting position corresponding to one of the loading or unloading of the at least one object on the at least one support in a plane, each support moving in the plane with a planetary movement along a closed curvilinear path surrounding a median axis, the axes of a three-dimensional frame of reference specific to the support always remain parallel to the oriented directions that the axes occupy in the starting position, and the machine is configured to impart to each support a movement such that a value of an acceleration imparted to the support during an evolution of the support along a path of the support is at any point greater than a value of an acceleration of gravity.

20. The winding machine according to claim 1, wherein an orientation of a plane is maintained constant relative to a frame of reference in a space constituted by a vertical, a meridian, and a parallel of the space.

* * * * *